US005952981A

United States Patent [19]

Takeichi

[11] Patent Number: 5,952,981

[45] **Date of Patent: *Sep. 14, 1999**

[54] ANTENNA FOR REDUCING AN EFFECT OF A RADIO WAVE BLOCKING OBSTACLE

[75] Inventor: Yoshihiro Takeichi, Kanagawa, Japan

[73] Assignee: MCC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/694,317

[22] Filed: Aug. 8, 1996

[30] Foreign Application Priority Data

Aug. 24, 1995 [JP] Japan ..... 7-239166

[51] Int. Cl.[6] ..... H01Q 13/00

[52] U.S. Cl. ..... 343/776; 343/705; 343/786

[58] Field of Search ..... 343/700 MS, 705, 343/708, 711, 713, 772, 776, 893, 786; H01Q 1/28

[56] References Cited

U.S. PATENT DOCUMENTS

| | | | |
|---|---|---|---|
| 3,611,388 | 10/1971 | Okumura | 343/712 |
| 3,702,479 | 11/1972 | Uhrig | 343/705 |
| 4,288,794 | 9/1981 | Osborne et al. . | |
| 4,308,541 | 12/1981 | Seidel et al. | 343/786 |
| 4,983,984 | 1/1991 | Shibano et al. | 343/711 |
| 5,048,641 | 9/1991 | Holcomb et al. . | |
| 5,184,141 | 2/1993 | Connolly et al. | 343/705 |

FOREIGN PATENT DOCUMENTS

| | | | |
|---|---|---|---|
| 0193145 | 11/1982 | Japan | 343/711 |
| 2295205 | 12/1990 | Japan . | |
| 5167344 | 7/1993 | Japan . | |
| 5218723 | 8/1993 | Japan . | |
| 6209206 | 7/1994 | Japan . | |
| 485062 | 5/1938 | United Kingdom . | |
| 584900 | 1/1947 | United Kingdom . | |
| 632813 | 12/1949 | United Kingdom . | |
| 751542 | 6/1956 | United Kingdom . | |

*Primary Examiner*—Don Wong
*Assistant Examiner*—Tho Phan
*Attorney, Agent, or Firm*—Leydig, Voit & Mayer, Ltd.

[57] ABSTRACT

An array antenna is located on an upper surface of a vehicle. The array antenna is oriented at a right angle to a radio wave blocking obstacle existing in a radio wave transmission path. A diffracted wave is effectively received at the shadowed portion where a direct wave is not transmitted because of the radio wave blocking obstacle. If the antenna dimension of its longitudinal direction is larger than that of the radio wave blocking obstacle, both direct wave and diffracted wave are received and therefore the reception power decrease caused by the radio wave blocking obstacle is further reduced.

23 Claims, 12 Drawing Sheets

ANTENNA FOR REDUCING AN EFFECT OF A RADIO WAVE BLOCKING OBSTACLE

BACKGROUND OF THE INVENTION

1. Field of the Invention

The invention relates to an antenna for reducing an effect of a radio wave blocking obstacle existing in a radio wave transmission path. More specifically, the invention relates to an array antenna having a plurality of element antennas, and to an aperture antenna.

2. Description of the Prior Art

In general, in case of receiving and transmitting radio waves, the reception power is reduced by a blocking obstacle, which exists in the radio wave transmission path between a transmitting point and a receiving point, and blocks the transmission of radio wave.

In order to obtain a desired reception power, it is inevitable to avoid or lessen the reception power decrease.

In the past, for the above requirement, the antennas are arranged at a place where the radio wave blocking obstacle does not disturb the radio wave transmission path.

If the antenna put in the radio wave transmission path is inevitably disturbed by the shadow of the radio wave blocking obstacle due to the change of relative position between the blocking obstacle and the antenna as time passes by, it is well known that the antennas which are placed in different places are switched as time passes by so that two antennas are not caught in the shadow of the blocking obstacle at the same time. Such manner is disclosed in the Japanese Patent Laid-Open publication No. 5-167344 etc., for example. In order to reduce the effect of the radio wave blocking obstacle, the structure of a conventional invention uses one of those antennas which is not caught in the shadow of the blocking obstacle by switching the antennas by turns along the passage of time.

However, although the conventional antennas operate as mentioned above, namely, the antennas which are not caught in the shadow of the blocking obstacle are selected, it is difficult to select which antenna is caught in the shadow of the radio wave blocking obstacle according to the locational relationship between the direction of a satellite, the blocking obstacle and the antennas. In other words, when the radio wave comes in from just above the antenna, the antenna just under the radio wave blocking obstacle is caught in the blocking obstacle's shadow. However, when the radio wave comes in obliquely toward the antenna, the antenna positioned obliquely under the radio wave blocking obstacle is caught in the blocking obstacle's shadow, while the antenna just under the radio wave blocking obstacle is kept away from the shadow. Accordingly, since the decision of which antenna is caught in the shadow of the radio wave blocking obstacle depends on the locational relationship between the direction of the satellite, the blocking obstacle and the antennas, it is difficult to select the antenna which is not caught in the shadow. This imposes restrictions on the arrangement or the structure of antennas and makes the switching control very complicated, in case of a conventional switching type antenna. Especially in case of performing a satellite communication by a rotorcraft like helicopter during the flight, since the rotor acts as a radio wave blocking obstacle, it is extremely difficult to avoid decreasing the reception power.

SUMMARY OF THE INVENTION

It is an object of the present invention to provide an antenna for eliminating the restriction on the antenna arrangement and the complexity of the structure as well as the complexity of the antenna control. This avoids the reception power decrease without switching a plurality of the antennas even if the antenna is caught in the blocking obstacle's shadow. That is, the antenna of the present invention does not need to select the antenna which is not caught in the shadow of the radio wave blocking obstacle.

It is another object of the present invention to provide an antenna wherein a large diffracted wave can be received and therefore reception power decrease by the radio wave blocking obstacle can be reduced. This effect can be obtained by the fact that the diffracted wave from the radio wave blocking obstacle comes in even at the location where direct radio wave does not come in, when a radio wave blocking obstacle exists in the radio wave transmission path and its shadow covers the antenna whose longitudinal direction is transversal or substantially transversal at a right angle to the longitudinal direction of a radio wave blocking obstacle.

It is still another object of the present invention to provide an antenna whose reception power decrease caused by the radio wave blocking obstacle is further reduced, when the antenna size of its longitudinal direction is larger than that of the radio wave blocking obstacle, since both direct wave and diffracted wave are received.

According to one aspect of the invention, an antenna for reducing an effect of a radio wave blocking obstacle is arranged on an upper surface of a vehicle, wherein longitudinal direction of the antenna is transversal or substantially transversal at a right angle to a longitudinal direction of a radio wave blocking obstacle existing in a radio wave transmission path.

According to another aspect of the invention, the antenna for reducing an effect of a radio wave blocking obstacle comprises a plurality of element antennas arranged toward the longitudinal direction of the antenna at regular intervals.

According to further aspect of the invention, an antenna for reducing an effect of a radio wave blocking obstacle comprises a plurality of element antennas arranged toward the longitudinal direction of the antenna at irregular intervals.

According to further aspect of the invention, an antenna for reducing an effect of a radio wave blocking obstacle comprises an aperture antenna.

According to further aspect of the invention, the antenna for reducing an effect of a radio wave blocking obstacle comprises a plurality of antennas arranged toward its longitudinal direction, and outputs from a plurality of the antennas are combined by hybrid circuits.

According to further aspect of the invention, the antenna for reducing an effect of a radio wave blocking obstacle is arranged on an upper surface of a rotorcraft, wherein longitudinal direction of the antenna is transversal or substantially transversal at a right angle to a longitudinal direction of a rotor existing in a radio wave transmission path.

According to further aspect of the invention, the antenna for reducing an effect of a radio wave blocking obstacle wherein a plurality of the antennas are arranged along a curved line or a polygonal line surrounding the rotation axis of the rotor.

According to further aspect of the invention, the antenna for reducing an effect of a radio wave blocking obstacle is arranged on a roof of a land vehicle such as an electric train or an automobile, wherein longitudinal direction of the antenna is transversal or substantially transversal at a right angle to a longitudinal direction of a steel poles or structural members and so on existing in a radio wave transmission path.

DETAILED DESCRIPTION OF THE PREFERRED EMBODIMENTS

Embodiment 1

Figure 1:
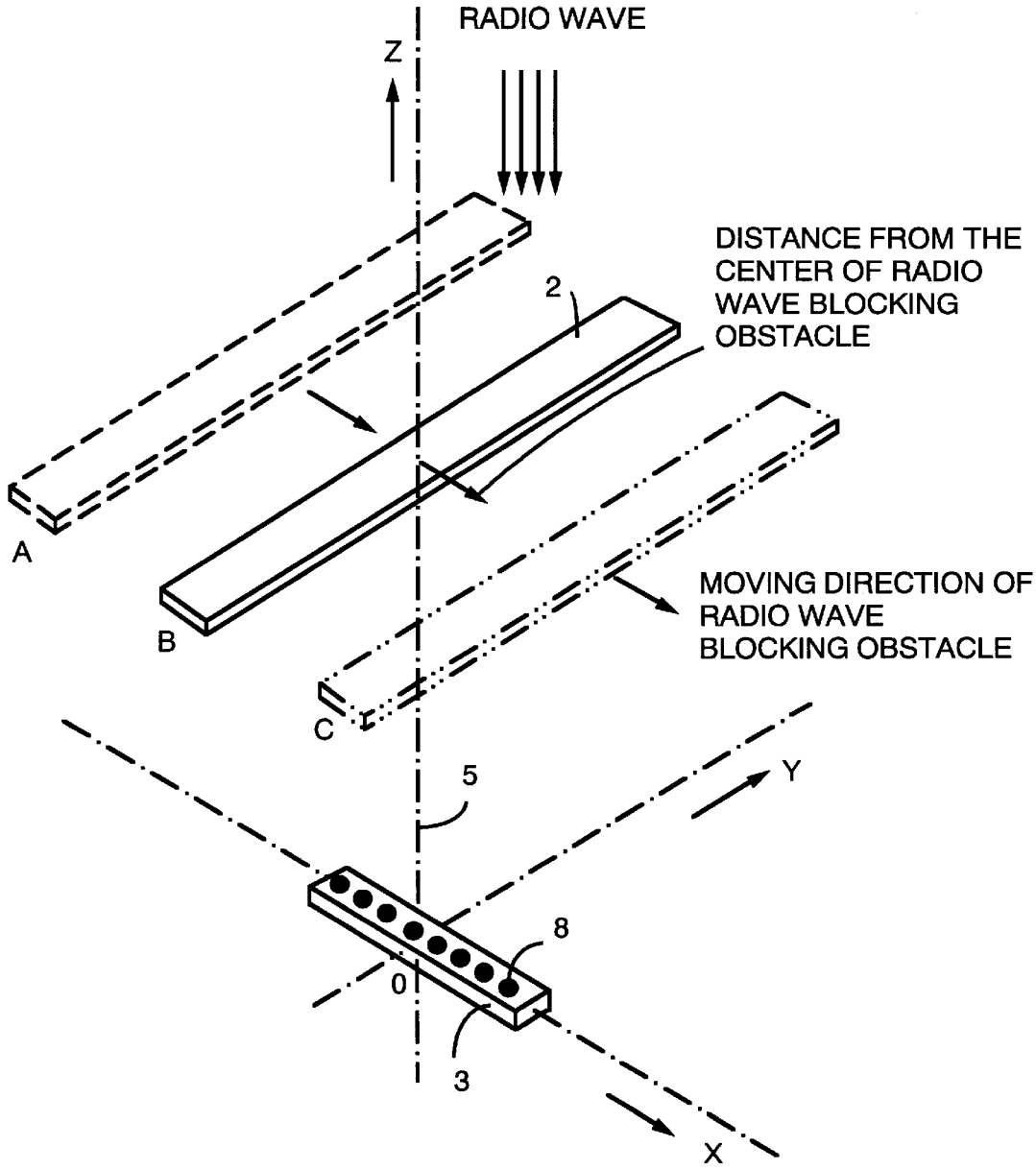
FIG. 1 shows a general structure of an array antenna according to embodiments of the present invention.

FIG. 1 shows a general structure of an array antenna according to a first embodiment of the present invention. In FIG. 1, the longitudinal direction (Y axis) of a radio wave blocking obstacle 2 is transverse to the direction (Z axis) of the incoming radio wave. The longitudinal direction (X axis) of an array antenna 3 is transverse to both the direction of the incoming radio wave and the longitudinal direction of the radio wave blocking obstacle.

In FIG. 1, the center of the array antenna 3 is placed at the origin O of the orthogonal three-dimensional space consisting of X, Y, Z axes. The longitudinal direction of the array antenna 3 lies on X axis. The longitudinal direction of the radio wave blocking obstacle 2 is parallel to Y axis. It is assumed that the radio wave blocking obstacle 2 is moving in the direction of the X axis along the passage of time. In this case, the origin of the movement of the radio wave blocking obstacle 2 is on the Z axis 5. Although the radio wave blocking obstacle 2 is located just above the center point O on the X axis at the present time (B point), it is located in the negative side of the X axis at a certain second ago as shown by the dotted line (A point) and it is located in the positive side of the X axis at a certain second after as shown by the double chain line (C point). Where, the location of the radio wave blocking obstacle 2 on the X axis shows a distance between the center of the array antenna 3 and that of the radio wave blocking obstacle 2.

Figure 2:
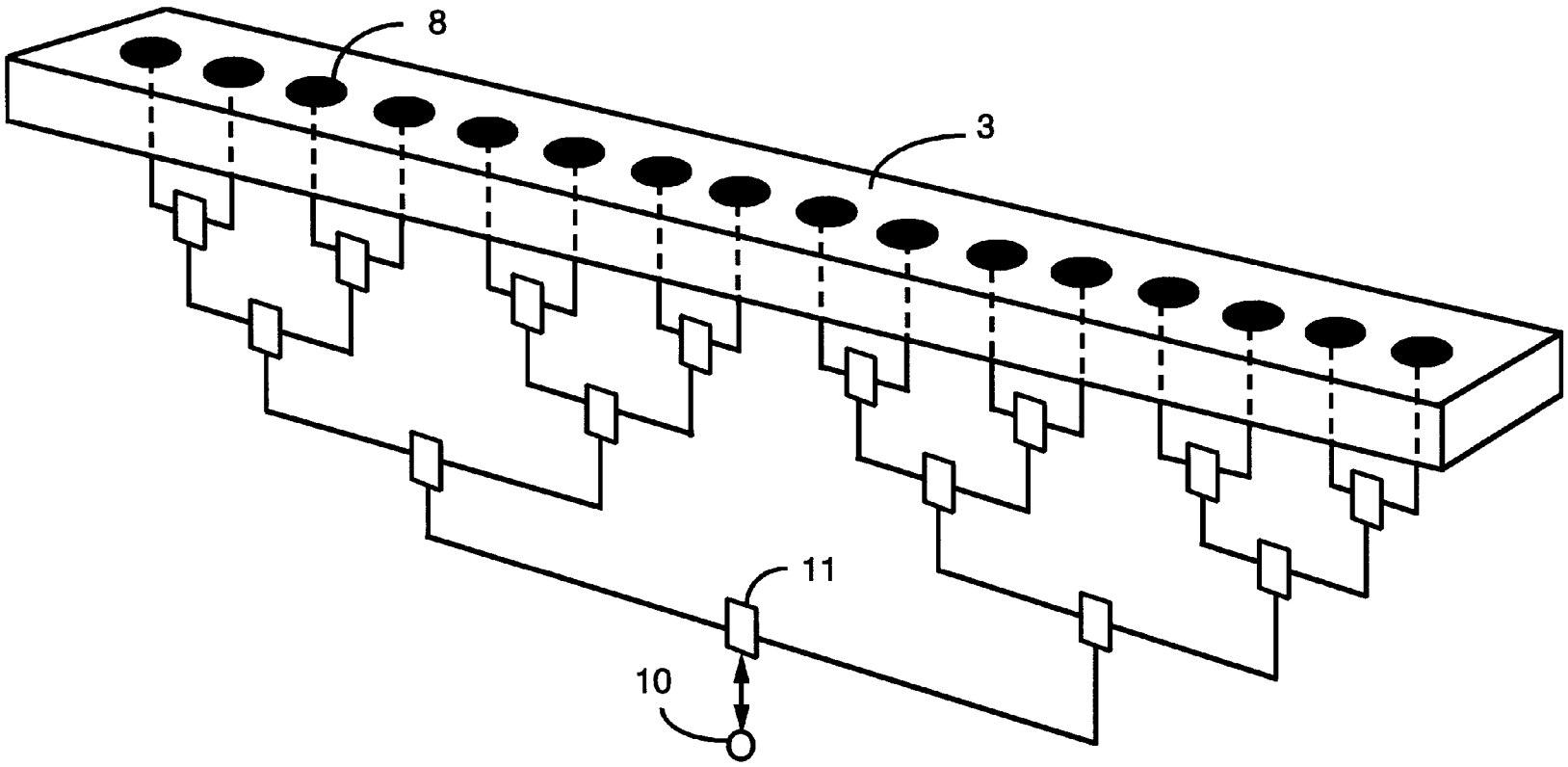
FIG. 2 shows a structure of an array antenna mainbody according to the first embodiment of the present invention.

FIG. 2 is a block diagram showing an example of a structure of the array antenna 3 used in the first embodiment. In FIG. 2, the array antenna 3 comprises a plurality of antenna elements 8 arranged at equal intervals. The antenna elements 8 are connected to an input/output terminal 10 via a plurality of hybrid circuits 11. For example, in FIG. 2, the array antenna comprises sixteen antenna elements 8 and fifteen hybrid circuits 11. It is also possible to form the array antenna 3 by other combinations. In this case, the distance from each antenna elements 8 to a hybrid circuit 11 should be set equally. Since this is a well known technique among those who are skilled in the art, it does not need further explanation.

Figure 3:
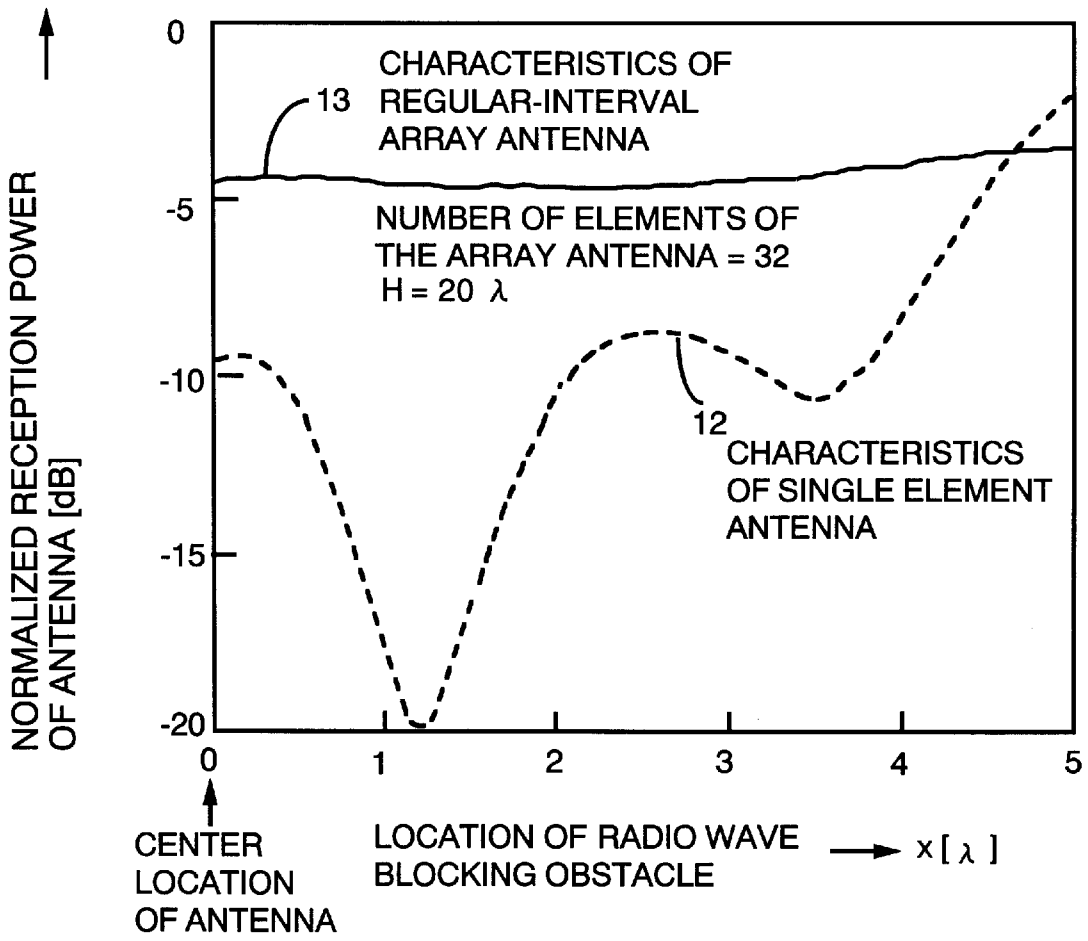
FIG. 3 shows the characteristics of an array antenna according to the first embodiment of the present invention shown in FIG. 2.

FIG. 3 shows characteristics of the array antenna 3 according to the first embodiment of the invention. Referring to FIG. 1, FIG. 2 and FIG. 3, the characteristics of the array antenna 3 of the first embodiment is explained below. The horizontal axis of FIG. 3 shows distance from the center of the array antenna 3 to the center location of the radio wave blocking obstacle 2 indicated by wave length $\lambda$. The vertical axis shows normalized reception power (dB) of the antenna.

In FIG. 3, it is assumed that the length of the radio blocking obstacle 2 is infinite in the Y axis direction, its width is $7.5\lambda$ in the X axis direction. It is also assumed that the array antenna 3 comprises thirty two antenna elements 8 arranged in the X axis direction at the interval of $\lambda/2$, and the reception power of respective antenna elements is combined by a plurality of hybrid circuits 11 in the same phase and is outputted to the input/output terminal 10. And it is also assumed that the distance H from the radio wave blocking obstacle 2 to the array antenna 3 toward the Z axis direction equals $20\lambda$.

In FIG. 3, the dotted line 12 shows a reception power of the antenna, when a single isotropic element antenna 8 is placed at the center point O on the X axis and the radio wave blocking obstacle 2 is moving from the center point of the X axis toward the positive direction of the X axis. As seen from the dotted line 12, when one antenna is used, the reception power fluctuates greatly along the movement of the radio wave blocking obstacle 2. Especially, the reception power is greatly affected by the radio wave blocking obstacle 2 when the radio wave blocking obstacle 2 is within the range around $\pm 4.5\lambda$ from the center of the X axis.

The solid line 13 shows a reception power of the antenna, when a $15.5\lambda$-length array antenna having thirty two antenna elements arranged in the X axis direction at the interval of $\lambda/2$ is laid in the X axis direction, and the radio wave blocking obstacle 2 is moving from the center point of the X axis toward the positive direction of the X axis. In FIG. 3, the vertical axis indicates reception power normalized by the reception power measured when there is no radio wave blocking obstacle 2. In this case, even if the radio wave blocking obstacle 2 is within the range around $\pm 4.5\lambda$ from the center of the X axis, the power attenuation due to the radio wave blocking obstacle 2 is around 4.5 dB at worst, namely the effect caused by the radio wave blocking obstacle 2 is decreased.

In general, the reception power decrease degree of the array antenna 3 due to the radio wave blocking obstacle 2 depends on the relative locational relationship between the radio wave blocking obstacle 2 and the array antenna 3. However, in case of the array antenna comprising thirty two element antennas, the reception power is attenuated by less than 4.5 dB, while the reception power due to the radio wave blocking obstacle 2 in case of a single isotropic antenna is attenuated by as much as 20 dB.

Embodiment 2

The above operation according to the first embodiment relates to an array antenna 3 in which the antenna elements 8 are arranged at the interval of half-wave length. However, this interval of the antenna elements 8 is not necessarily restricted to the half-wave length, and to the equal intervals. The array antenna 3 according to the first embodiment is constructed in order to avoid the reception power decrease rather than to obtain a large gain. Accordingly, it is desirable for the purpose of the present invention to set widely and irregularly the intervals between the elements antennas 8, to extend the longitudinal direction of the array antenna 3, and to restrain the grating lobe or the side lobe. The grating lobe especially reduces the gain by widely dispersing the radiation power to other direction than the main lobe. When transmitting the radiation power, the grating lobe may interfere with others by radiating radio wave toward other directions, while receiving the radiation power, it may bring interference from other directions. Accordingly, the restriction on the grating lobe is important.

Figure 4:
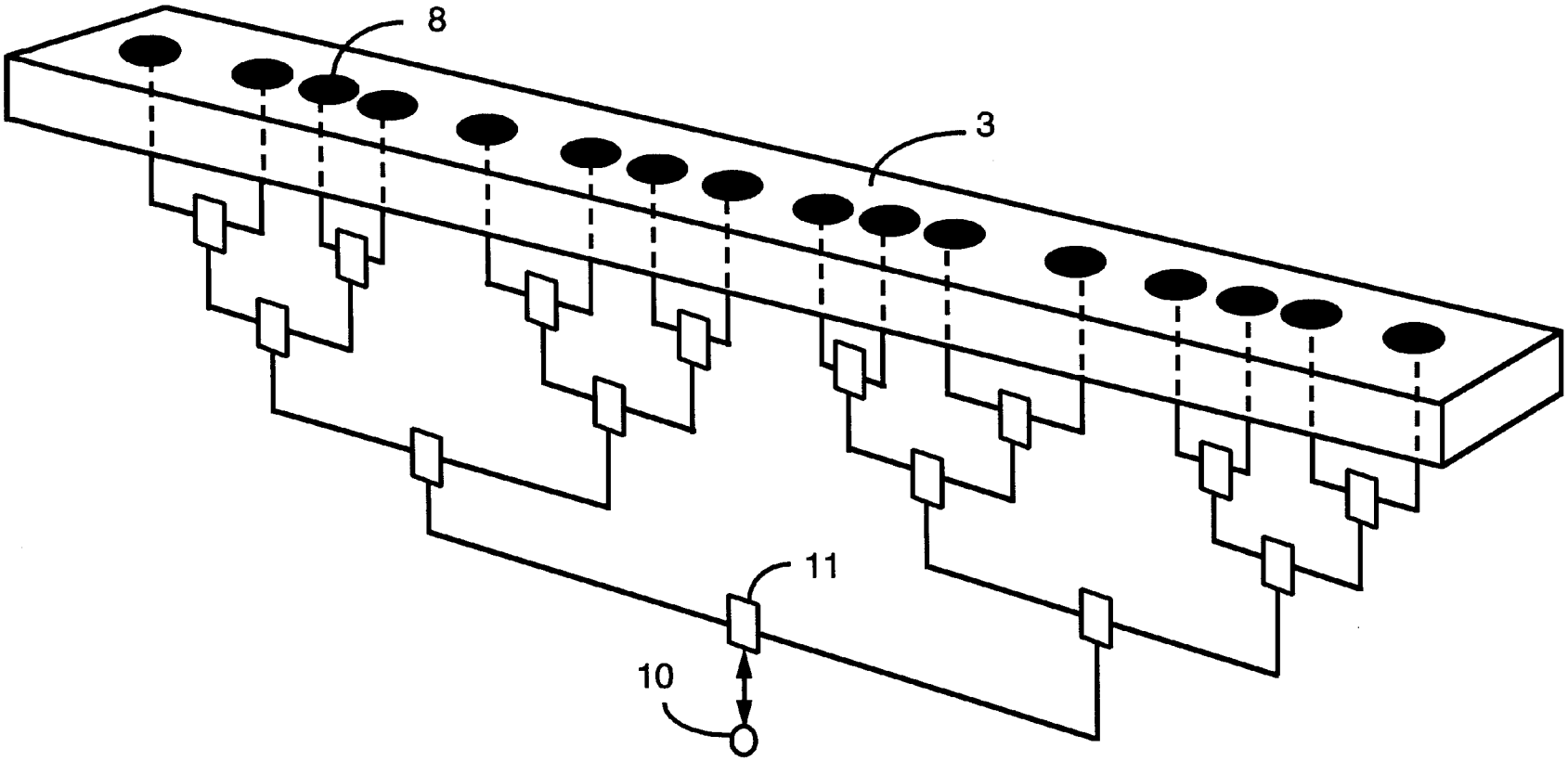
FIG. 4 shows a structure of an array antenna mainbody according to a second embodiment of the present invention.

As for an array antenna, it is well known to arrange the interval between the antenna elements irregularly for restricting the grating lobes, which are generated when the antenna elements are arranged at wide intervals. According to the present invention, as long as the dimension of the array antenna toward the longitudinaldirection is constant, the number of the antenna elements is reduced by arranging them at irregular intervals, which may provide an economical array antenna. Based on this idea, FIG. 4 shows an array antenna according to the second embodiment. The array antenna 3 combines antenna elements 8 having wide intervals with element antennas 8 having narrow intervals at irregular intervals. The elements having the same reference numbers in FIG. 4 are the same portions or the corresponding portions in FIG. 2. Accordingly the detailed explanation of the same portions is omitted.

Figure 5:
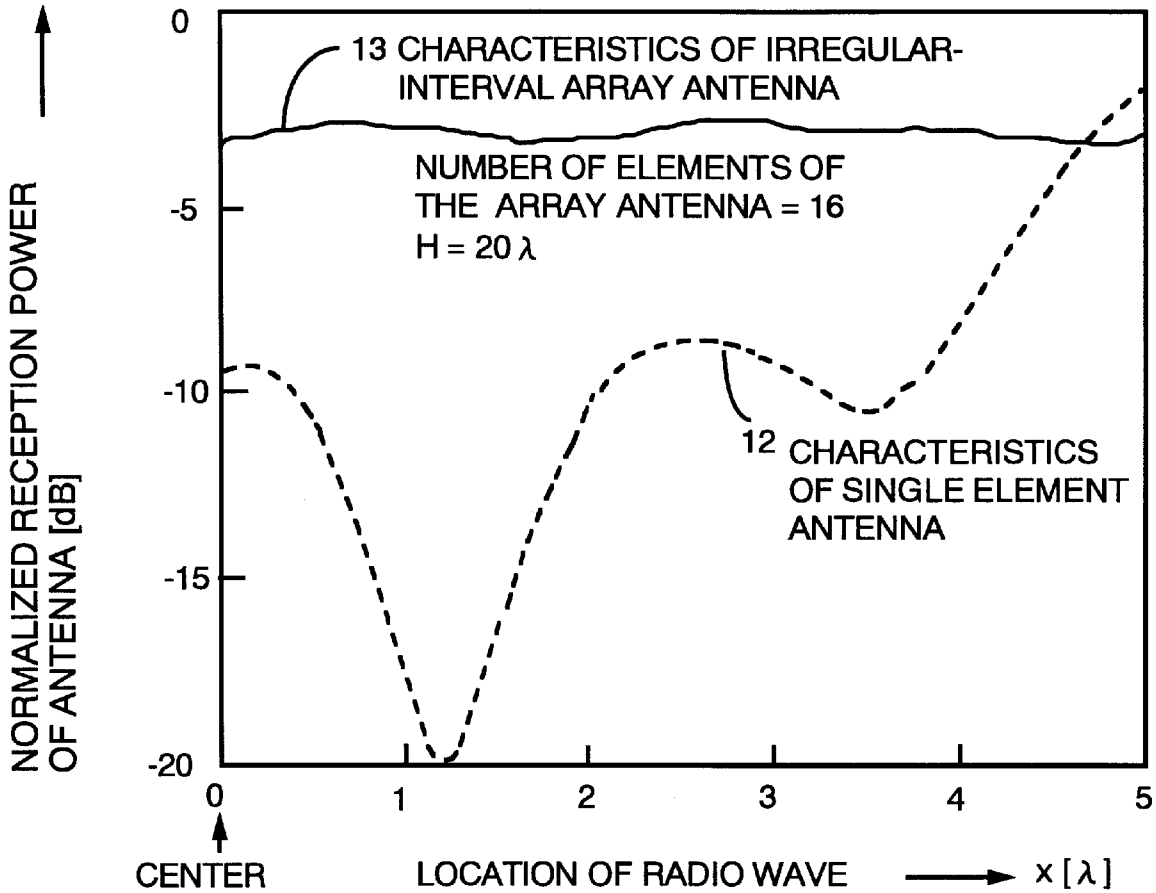
FIG. 5 shows the characteristics of an array antenna according to the second embodiment of the present invention shown in FIG. 4.

An operation of the array antenna shown in FIG. 4 is explained using FIG. 5. In FIG. 5, the solid line 13 shows the reception power of the array antenna of the second embodiment, when the radio wave blocking obstacle 2 is moving from the center point of the X axis toward the positive direction of the X axis, wherein the array antenna is laid toward the X axis direction, in which sixteen antenna elements 8 are arranged toward the X axis direction at irregular intervals, whose total arrangement length is 20λ. In FIG. 5, the reception power is also normalized by the reception power measured when there is no radio wave blocking obstacle 2, in the same manner as in FIG. 3. In FIG. 5, the dotted line 12 shows a reception power of a single antenna 8, when the radio wave blocking obstacle 2 is moving from the center point of the X axis toward the positive direction of the X axis, wherein the single isotropic antenna elements 8 is placed at the center point O on the X axis, in the same manner as shown in FIG. 3.

In case of an array antenna shown in FIG. 4 which comprises sixteen antenna elements arranged at irregular intervals, the reception power decrease of the array antenna 3 due to the radio wave blocking obstacle 2 is reduced to less than 3.5 dB as shown in FIG. 5. On the other hand, in case of a single isotropic antenna, it is as much as 20 dB at maximum as shown by the dotted line 12.

Although the above-mentioned embodiments are referring to the array antenna in which isotropic element antennas are arranged on a straight line at regular or irregular intervals as a model of the array antenna 3 in operation, the antenna elements 8 is not restricted to the isotropic one. With regard to an arrangement line, it is not necessarily restricted to a straight line. For example, the antenna elements may be arranged on a staggered line. Moreover, it is not necessarily a single line. Even if a plurality of arrangement lines is provided in parallel, a desired operation of the present invention may be obtained. When the reception power is weak, if the plurality of the array antennas 3 are provided in parallel, then the output power can be enhanced by combining the reception signals with the hybrid circuit.

Although, in the above-mentioned embodiments, the antenna elements 8 are connected in the order of their arrangement for every two of them with the hybrid circuit 11, the antenna elements are not necessarily connected in the order of their arrangement. It is also possible to obtain a desired operation of the invention, if the hybrid circuits 11 are substituted by other circuits.

Embodiment 3

Figure 6:
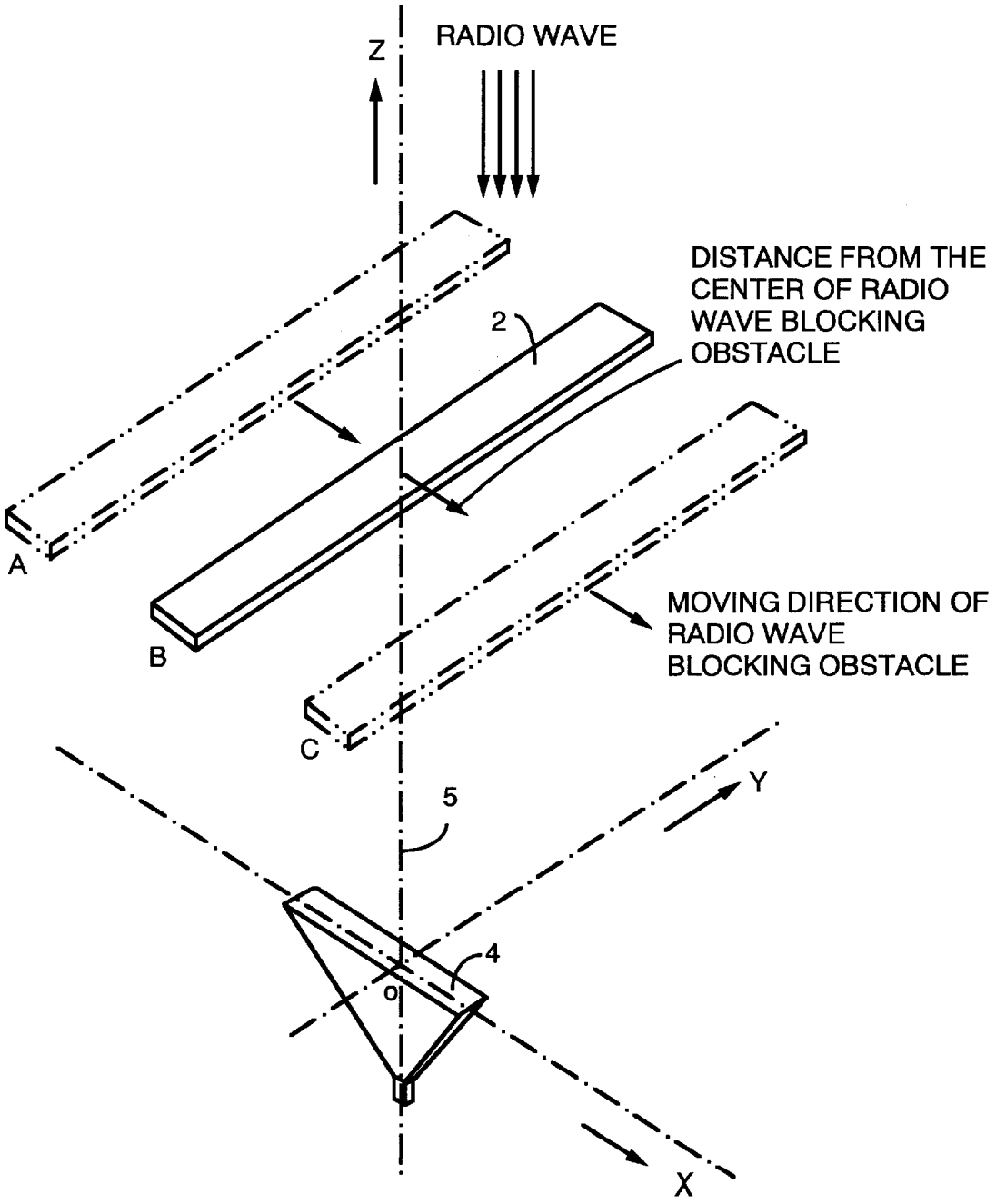
FIG. 6 shows a structure of an aperture antenna mainbody according to a third embodiment of the present invention.

Furthermore, it is possible to obtain desired characteristics of the invention, if the antenna used in the above embodiments is other types of antenna other than the array antenna, as long as it has a similar characteristic to that of the array antenna. For example, the array antenna may be substituted by a rectangular or an elliptical aperture antenna. FIG. 6, which is similar to FIG. 1, shows a rectangular aperture antenna 4 which is substituted for the array antenna 3 shown in FIG. 1. If the rectangular aperture antenna 4 lies on the X axis toward the longitudinal direction of the aperture of the rectangular aperture antenna 4, the same characteristics as shown by curve 13 in FIG. 3 can be obtained.

Embodiment 4

Figure 7:
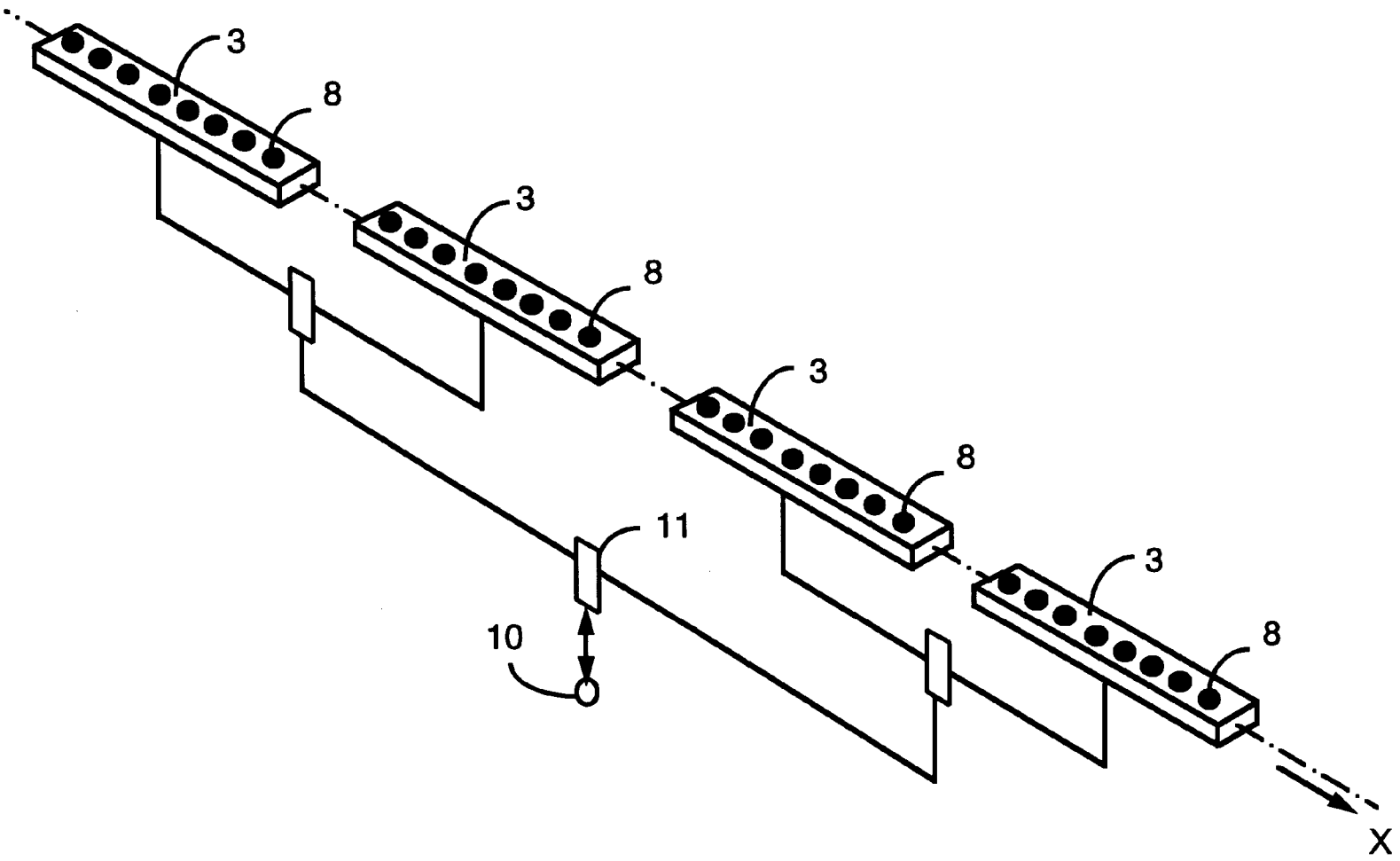
FIG. 7 shows a structure of an antenna mainbody according to a fourth embodiment of the present invention.

If the above plurality of antenna elements from a single array antenna, and a plurality of the single array antennas are arranged in a line toward the longitudinal direction, a desired characteristics can be also obtained. FIG. 7 shows such a plurality of single array antenna system in which a plurality of array antennas 3 are arranged in their longitudinal direction, namely toward the X axis direction. In this case, since the output power from the array antenna 3 which is located away from the shadow of the radio wave blocking obstacle 2 can be combined by the hybrid circuit 11, better antenna characteristics may be obtained.

Embodiment 5

Figure 8:
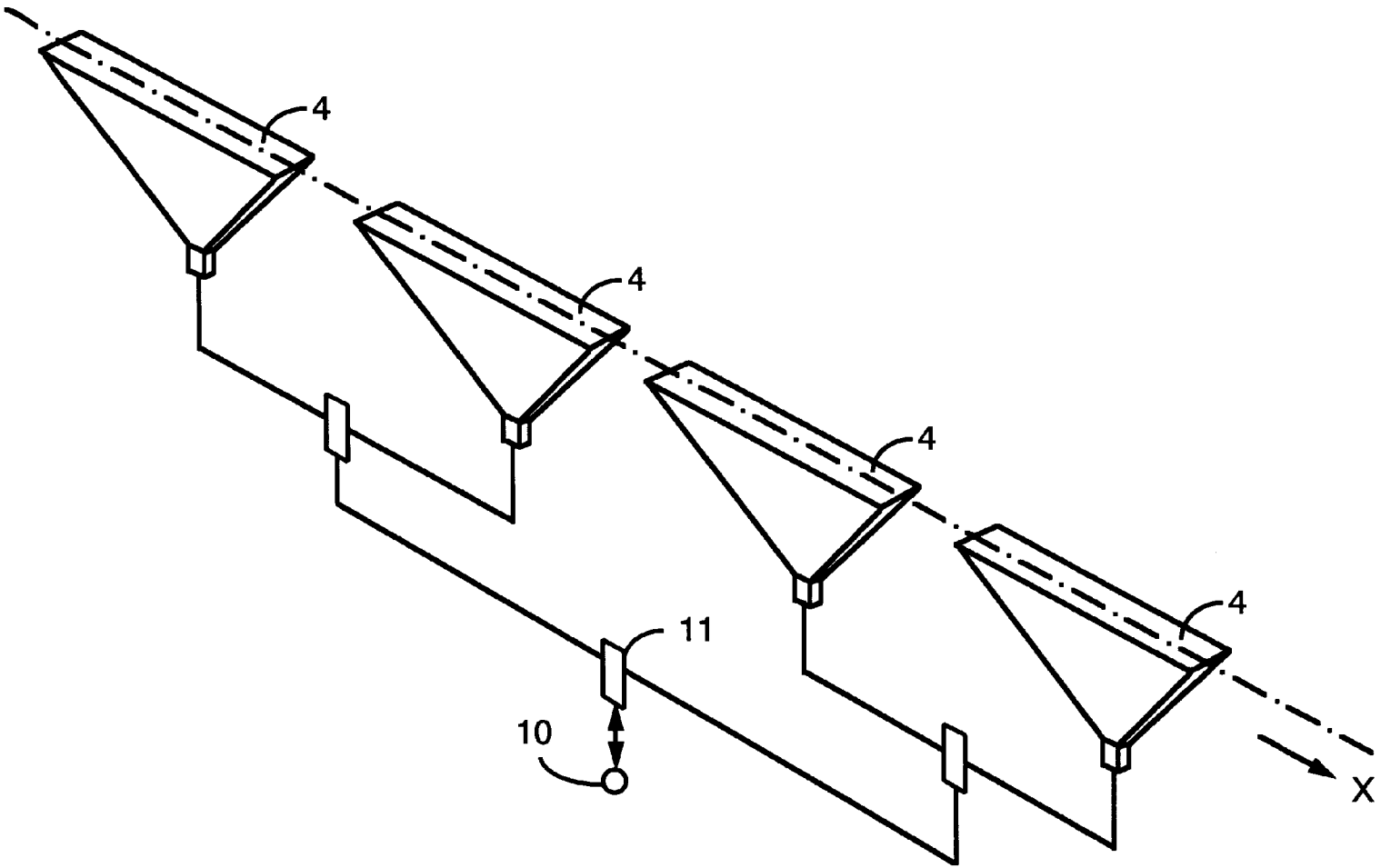
FIG. 8 shows a structure of an antenna mainbody according to a fifth embodiment of the present invention.

FIG. 8 shows an array antenna comprised of a plurality of the above-mentioned aperture antennas 4 shown in FIG. 6. The aperture antenna 4 here is regarded as a single element antenna and a plurality of them are arranged toward the longitudinal direction. This structure also gives desired characteristics. In FIG. 8, the antenna system in which a plurality of aperture antenna 4 are arranged toward their longitudinal direction, namely, toward the X axis direction. As shown in FIG. 8, since the output power from the aperture antenna 4 which is located away from the shadow of the radio wave blocking obstacle 2 can be combined by the hybrid circuit 11, better antenna characteristics may be obtained. Although a rectangular aperture antenna is used in FIG. 8, it is needless to say that almost the same characteristics may be obtained even if the rectangular aperture antennas are substituted by elliptical aperture antennas and so on.

Embodiment 6

Figure 9:
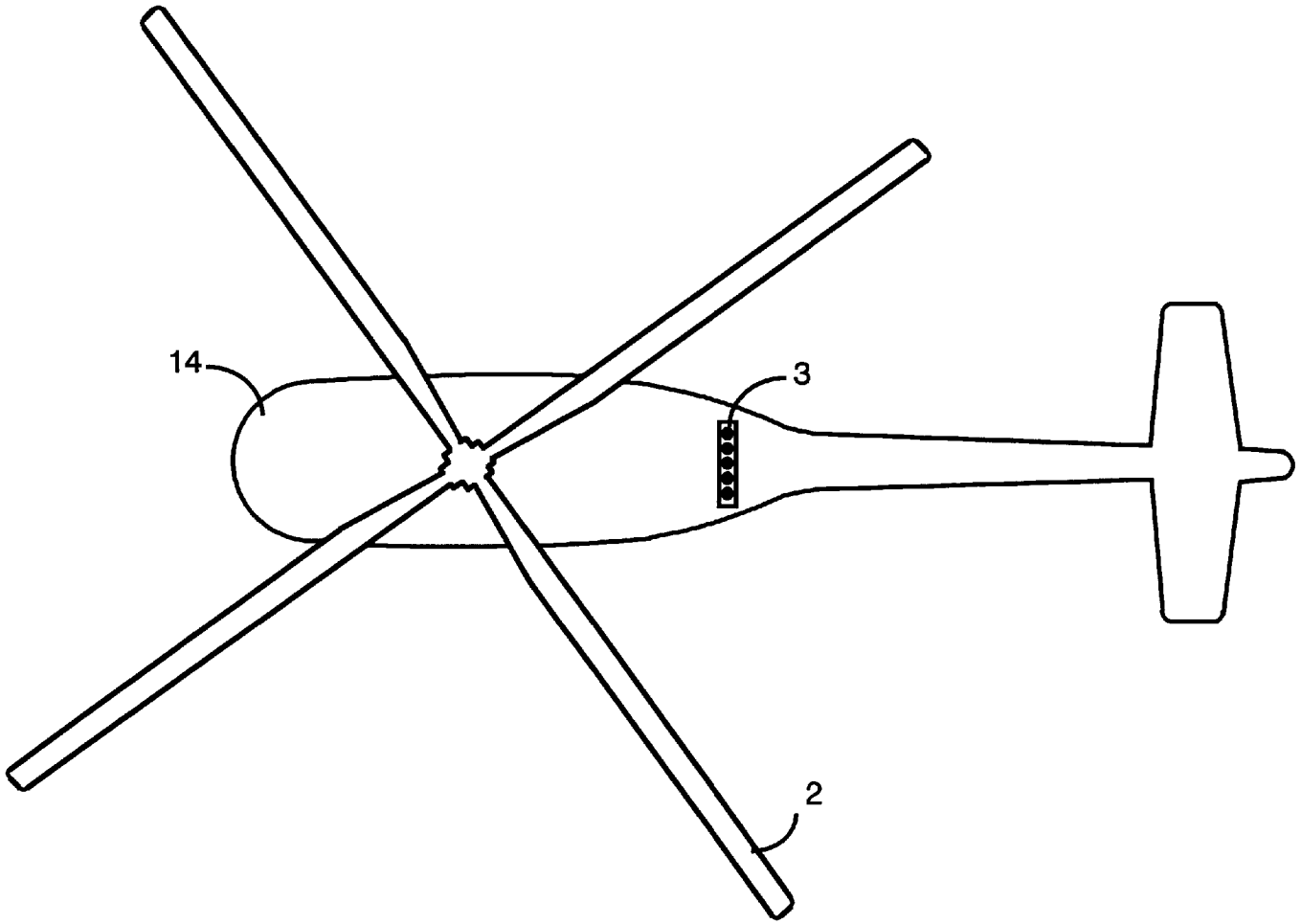
FIG. 9 shows an antenna structure placed on a helicopter according to a sixth embodiment of the present invention.

FIG. 9 shows an antenna structure for reducing the reception power decrease. In FIG. 9, the above-mentioned antenna is placed on upper surface of the helicopter to reduce the reception power decrease when radio wave from a satellite is blocked by the rotor. A rotor 2 and an antenna 3 in FIG. 9 correspond to the radio wave blocking obstacle 2 and the array antenna 3 in the first embodiment, respectively. That is, the rotor 2 acts as a radio wave blocking obstacle 2. In FIG. 9, it is assumed that the radio wave comes in from the above of FIG. 9 to the upper surface of the helicopter 14. In case of using a stationary communication satellite, the radio wave comes in obliquely to the helicopter 14. In this case, it is expected that the array antenna 3 is equally or less affected by the rotor 2, if compared to the radio wave which comes in from just above the helicopter 14.

As shown in FIG. 9, the array antenna 3 is arranged a little away from the center of the rotor 2 of the helicopter 14, so that the array antenna 3 is placed transversal to the longitudinal direction of the rotor 2 of the helicopter 14. If the rotor 2 of the helicopter 14 consists of two parts of different materials, namely a portion which is transparent for the radio wave and a metallic portion arranged on the leading edge of the rotor 2 which is not transparent for the radio wave, the width of the radio wave blocking obstacle corresponds to that of the metallic portion.

According to this sixth embodiment, since a plurality of antenna arranged on the helicopter 14 are not necessary to be switched in accordance with the rotation of the rotor 2, the number of antenna may be reduced and the switching unit may be eliminated, in comparison with the conventional antenna arranged on the helicopter. Accordingly, the whole structure of an antenna system may be small and simplified.

Embodiment 7

Figure 10:
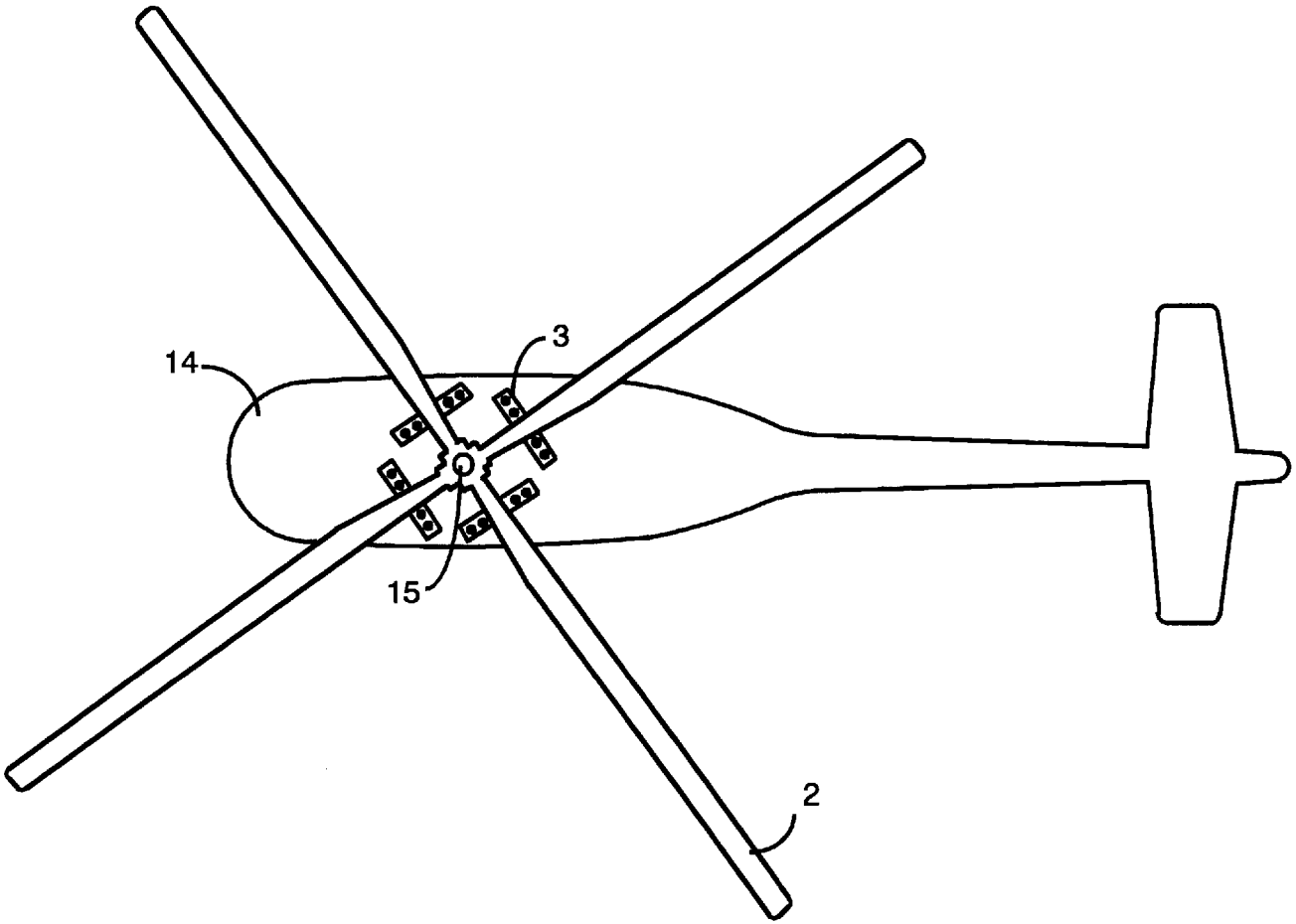
FIG. 10 shows an antenna structure placed on a helicopter according to a seventh embodiment of the present invention.

FIG. 10 shows an antenna structure placed on the upper surface of the helicopter according to a seventh embodiment of the present invention. The array antenna 3 is arranged close to the rotation axis of the rotor so that the rotation axis is surrounded by the array antennas arranged on the upper surface of the helicopter.

As shown in FIG. 10, the array antennas 3 are arranged close to the center of the rotor 2 of the helicopter 14 so that their longitudinal direction goes along a curved line or a polygonal line surrounding the rotation axis 15, which makes the array antennas 3 and the rotor 2 transversal. These four array antennas 3 are switched by turns according to the relative relationship between the incoming direction of the radio wave and the heading of the helicopter, in case that the radio wave comes in obliquely to the main body of the helicopter. In this case, the antenna system is switched to any of antennas which face in the direction of a satellite, not for switching the antenna system to any of antennas which are not caught in the shadow of the radio wave blocking obstacle 2, as in the conventional art. In other words, an appropriate antenna is switched from time to time according to the direction of the satellite and the location and the heading of the helicopter. This switching is easily performed by the program control. Although four array antennas 3 consisted of a plurality of element antennas in a straight line shape are shown in FIG. 10, the number of array antennas may be arbitrarily selected.

Although respective array antennas 3 comprise the element arrays arranged on a straight line shape in the seventh embodiment, other shapes of array antennas 3 can be arranged which may also obtain a desired characteristics. For example, it is possible to arrange the antenna elements on a portion of a circumference so that an array antenna whose shape is a portion of the circumference is obtained. Then the circumference shaped array antenna may be arranged along the circumferential curves. In FIG. 10, the radio wave comes in to the helicopter from above the helicopter.

According to this seventh embodiment, it is not necessary to switch respective array antennas in accordance with the rotation of the rotor 2. This reduces the number of the antennas arranged on the helicopter and eliminates a switching unit which operates according to the rotation of the rotor 2. Accordingly, the whole structure of an antenna system may be small and simplified.

Needless to say, if the incoming direction of the radio wave changes, the array antenna can follow the change of the direction of the radio wave by giving a required phase difference to the antenna elements such as changing the direction of the antenna or forming the array antenna into a phased array type antenna.

Embodiment 8

Figure 11:
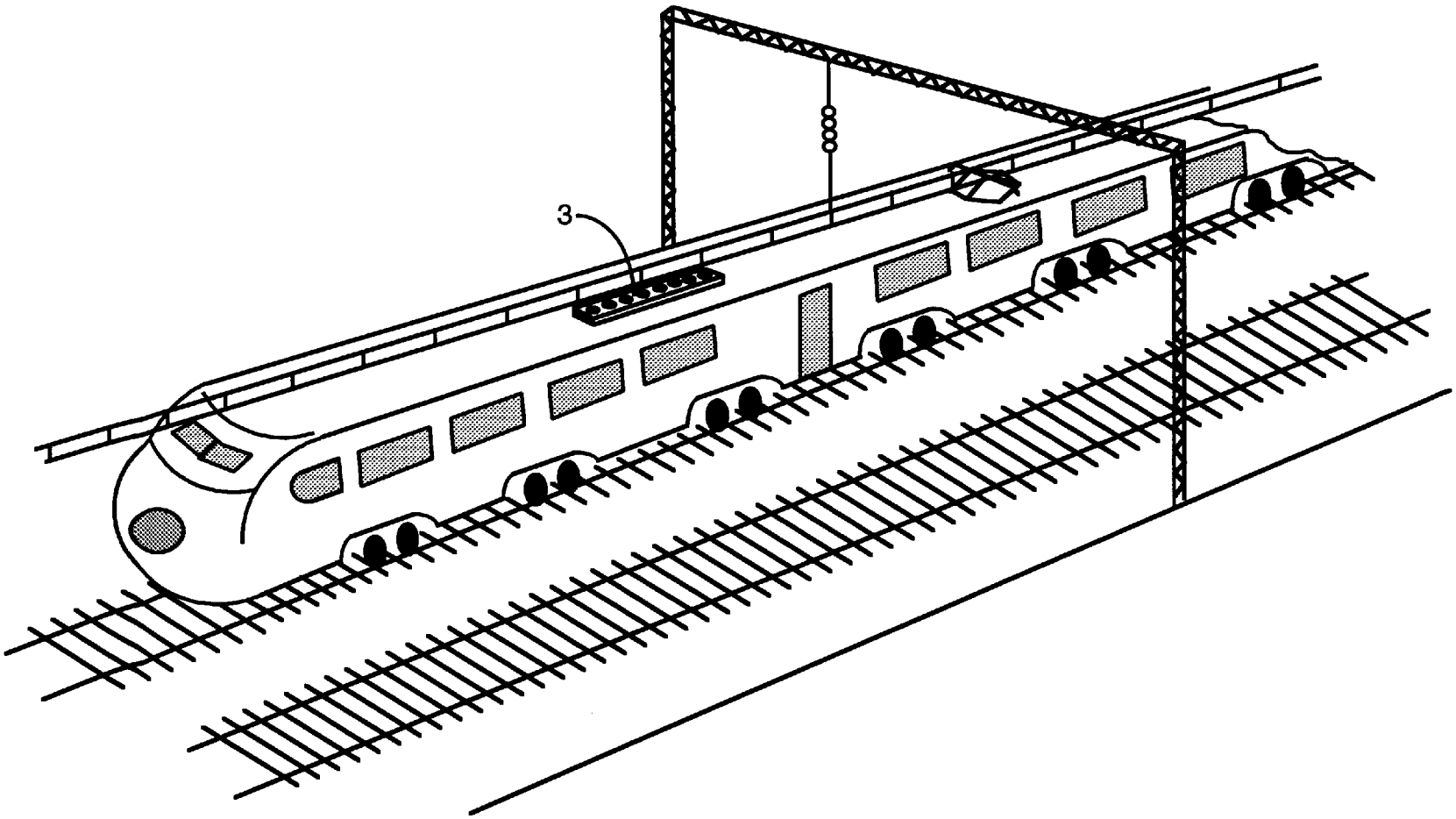
FIG. 11 shows an antenna structure placed on an electric train according to an eighth embodiment of the present invention.

FIG. 11 shows an antenna system arranged on an electric train according to an eighth embodiment of the present invention. The array antenna 3 of the eighth embodiment is usually arranged on the roof of the electric train. In FIG. 11, beams across steel poles for feeding the electric power to the electric train act as a radio wave blocking obstacle. The array antenna 3 is arranged along the running direction of the train so that its longitudinal direction is transverse to the radio wave blocking obstacle, namely the beam. It is also possible to arrange longitudinal direction of the plurality of array antennas 3 in the running direction of the electric train. These plurality of array antennas 3 are connected by the hybrid circuit 11 to each other in order to operate them as space diversity antennas. According to this eighth embodiment, the blocking effect caused by the beam across the steal pole for feeding the electric power is reduced.

Embodiment 9

Figure 12:
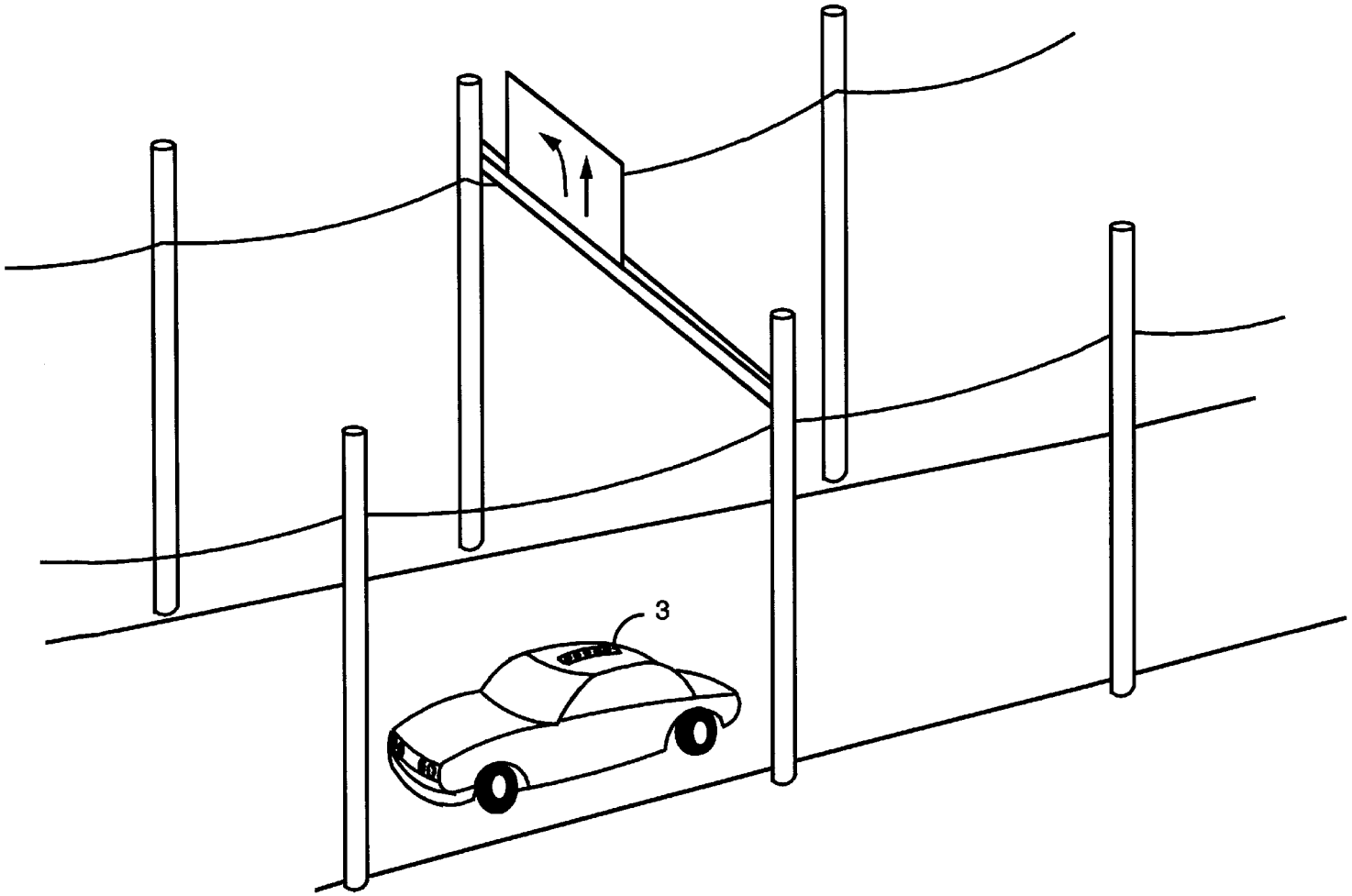
FIG. 12 shows an antenna structure placed on an automobile according to an ninth embodiment of the present invention.

FIG. 12 shows an antenna structure placed on an automobile according to a ninth embodiment of the present invention. The array antenna 3 is usually arranged on the roof of an automobile. In FIG. 11 and FIG. 12, since any structural members across a railroad or a road acts as a radio wave blocking obstacle, the array antenna 3 is arranged along the running direction of the train or car so that their longitudinal directions are transverse to the longitudinal directions of the radio wave blocking obstacle, namely the structural members. Needless to say, the present invention is applicable to vehicles such as trains, which are drawn by an electric locomotive, other than the electric train. Since electric poles may be radio wave blocking obstacles when the radio wave reaches the electric train or the automobile obliquely, this array antenna on the roof is also effective to the electric poles. It is also possible to arrange longitudinal direction of the plurality of array antennas 3 arranged on the roof of the train and the car in their running direction. These plurality of array antennas 3 are connected by the hybrid circuit 11 to each other in order to operate them as space diversity antennas. According to this ninth embodiment, the effect caused by the structural members or poles along the road is reduced.

The above-mentioned embodiments are referring to the case of using array antennas 3. Needless to say, a similar characteristics may be obtained using aperture antennas 4.

What is claimed is:

1. An antenna system comprising:

an array antenna comprising a plurality of antenna elements performing as a single aperture for receiving or transmitting radio waves without switching between the plurality of antenna elements when a radio wave blocking obstacle is positioned in front of the array antenna in a radio wave transmission path, the array antenna being mounted directly to the upper surface of a vehicle, with a portion of the array antenna being located within shadows of the radio wave blocking obstacle, the radio wave blocking obstacle comprising an elongate member extending in a first direction, the plurality of antenna elements being aligned in a second direction transverse to the first direction.

2. The antenna system of claim 1, wherein the plurality of antenna elements are spaced at regular intervals from each other.

3. The antenna system of claim 1, wherein the plurality of antenna elements are spaced at irregular intervals from each other.

4. The antenna system of claim 1, wherein the plurality of antenna elements each comprise an aperture antenna.

5. The antenna system of claim 1, wherein each antenna element of the plurality of antenna elements produces a separate output signal, and wherein the antenna system comprises:

a plurality of hybrid circuits coupled to the plurality of antenna elements for combining the separate output signals.

6. The antenna system of claim 5, wherein the plurality of antenna elements are spaced at regular intervals from each other.

7. The antenna system of claim 5, wherein the plurality of antenna elements are spaced at irregular intervals from each other.

8. The antenna system of claim 5, wherein the plurality of antenna elements each comprise an aperture antenna.

9. The antenna system of claim 1, wherein the array antenna comprises at least about sixteen elements.

10. The antenna system of claim 1 wherein the portion of the array antenna located within the shadows of the radio wave blocking obstacle is ON and receives a diffracted radio wave.

11. An antenna system comprising:

an array antenna including a plurality of antenna elements performing as a single aperture for receiving or transmitting radio waves without switching between the plurality of antenna elements when a radio wave blocking obstacle is located in a radio wave transmission path, the array antenna being located on an upper surface of a rotorcraft, with a portion of the array antenna being located in shadows of the radio wave blocking obstacle, wherein the radio wave blocking obstacle includes a rotor traveling in a first direction, and the plurality of antenna elements are aligned in a second direction tangential to the first direction.

12. The antenna system of claim 11, wherein the plurality of antenna elements are spaced at regular intervals from each other.

13. The antenna system of claim 11, wherein the plurality of antenna elements are spaced at irregular intervals from each other.

14. The antenna system of claim 11, wherein the plurality of antenna elements each comprise an aperture antenna.

15. The antenna system of claim 11, wherein each antenna element of the plurality of antenna elements produces a separate output signal and wherein the antenna system comprises:

a plurality of hybrid circuits coupled to the plurality of antenna elements to combine the separate output signals.

16. The antenna system of claim 11, comprising:

a plurality of array antennas each comprising a plurality of antenna elements, the plurality of array antennas located on the upper surface of the rotorcraft for receiving radio waves originating from above the rotorcraft, wherein the plurality of array antennas are arranged in a polygonal configuration about a rotation axis of the rotor.

17. The antenna system of claim 11 wherein the portion of the array antenna located within the shadows of the radio wave blocking obstacle is ON and receives a diffracted radio wave.

18. An antenna system comprising:

an array antenna including a plurality of antenna elements performing as a single aperture for receiving or transmitting radio waves without switching between the plurality of antenna elements when a radio wave blocking obstacle is positioned in front of the plurality of antenna elements in a radio wave transmission path, the array antenna being mounted directly to the roof of a land vehicle, with a portion of the array antenna being located with shadows of the radio wave blocking obstacle, the radio wave blocking obstacle including a structural member comprising an elongate member extending in a first direction, the plurality of antenna elements being aligned in a second direction transverse to the first direction.

19. The antenna system of claim 18, wherein the plurality of antenna elements are spaced at regular intervals from each other.

20. The antenna system of claim 18, wherein the plurality of antenna elements are spaced at irregular intervals from each other.

21. The antenna system of claim 18, wherein the plurality of antenna elements each comprise an aperture antenna.

22. The antenna system of claim 18, wherein the plurality of antenna elements of each produce a separate output signal, and wherein the antenna system comprises a plurality of hybrid circuits coupled to the plurality of antenna elements to combine the separate output signals.

23. The antenna system of claim 15 wherein the portion of the array antenna located within the shadows of the radio wave blocking obstacle is ON and receives a diffracted radio wave.

* * * * *